United States Patent [19]

Robinson

[11] 3,990,700

[45] Nov. 9, 1976

[54] ADJUSTING STRING TENSION

[75] Inventor: Mark L. Robinson, Newburyport, Mass.

[73] Assignee: Acro, Inc., Stoneham, Mass.

[22] Filed: Aug. 25, 1975

[21] Appl. No.: 607,145

[52] U.S. Cl. ..... 273/73 E

[51] Int. Cl.[2] ..... A63B 51/12

[58] Field of Search ..... 273/73 R, 73 C, 73 D, 273/73 E, 73 G, 73 H

[56] References Cited

UNITED STATES PATENTS

| | | | |
|---|---|---|---|
| 1,562,881 | 11/1925 | Gower et al. | 273/73 H |
| 3,642,283 | 2/1972 | Wilkens | 273/73 H X |

FOREIGN PATENTS OR APPLICATIONS

| | | | |
|---|---|---|---|
| 2,049,750 | 5/1972 | Germany | 273/73 G |
| 447,638 | 5/1936 | United Kingdom | 273/73 J |
| 28,838 | 12/1902 | United Kingdom | 273/73 D |
| 4,305 | 2/1914 | United Kingdom | 273/73 E |
| 178,694 | 4/1922 | United Kingdom | 273/73 E |

OTHER PUBLICATIONS

"The Sporting Goods Dealer;" May 1975; p. 154.

*Primary Examiner*—Richard J. Apley
*Attorney, Agent, or Firm*—Charles Hieken; Jerry Cohen

[57] ABSTRACT

A game racket with adjustable string tension includes a yoke in the throat portion of the racket to which main strings may be secured that engages opposed inside portions of the frame in the throat at upper and lower opposed pairs of points. A tension member secured between the yoke and handle portion of the racket is adjustable in length as an adjusting screw is rotated to control the position of the yoke in the throat and the main and cross string tension.

10 Claims, 8 Drawing Figures

ADJUSTING STRING TENSION

BACKGROUND OF THE INVENTION

The present invention relates in general to adjusting game racket string tension and more particularly concerns novel apparatus and techniques for simultaneously adjusting both main and cross string tension with relatively little additional structure that negligibly interferes with the weight and balance of the racket while remaining playable over a wide range of tension adjustments.

It is known in the prior art that game racket strings may be tightened by adjusting a yoke in the racket throat generally of a shape that conforms to the opposed inside racket portions abutting the yoke and supporting main strings at the top of the yoke so that drawing the yoke towards the handle lengthens the main strings to increase their tension and widens the racket frame to tighten the cross strings as described in British Pat. No. 28,838 accepted Dec. 31, 1903.

Much time and effort has been expended in adapting this approach to rackets described in U.S. Pat. No. 3,625,512 and 3,664,669 with coinventor Latham of these patented commercially successful inventions. Merely drawing the yoke of the above patents toward the handle to effect string tightening was found to be unacceptable in terms of providing a playable racket with string tension adjustable and maintainable over a reasonable range.

Accordingly, it is an important object of this invention to provide improved methods and means for adjusting string tension in game rackets.

It is another object of the invention to achieve the preceding object while overcoming problems inherent in merely moving a conventional yoke to effect string tension adjustment.

It is still a further object of the invention to achieve one or more of the preceding objects while providing string tension adjustment over a reasonable range, maintaining the selected tension and playability of the racket.

It is another object of the invention to achieve one or more of the preceding objects with a game racket of good weight and balance.

It is a further object of the invention to achieve one or more of the preceding objects with structure that is relatively easy and inexpensive to fabricate, assemble and adjust.

SUMMARY OF THE INVENTION

According to the invention, a racket includes a frame having a handle portion with handle means for gripping by a player, a portion with head means for supporting racket strings and means defining a throat portion intermediate the head and handle portions for accommodating yoke means for supporting main strings and functioning as a support member for the frame, and means for relatively displacing the yoke means and the frame between any of a continuum of positions between a first position of minimum string tension with the yoke means away from the handle portion and a second position of maximum string tension with the yoke means closer to the handle portion than in the first position. The yoke means engages the inside opposed surfaces of the frame in the throat portion at opposed pairs of points separated from each other in a direction along the length of the racket by a distance that is a number of times greater than the length of the yoke means portion in contact with the inside surfaces of the frame to induce failure in the columns between the top of the yoke means and the handle means that is limited by the bottom of the yoke means to effectively form two pairs of shorter columns not in failure, one between the adjacent pairs of opposed points, the other from the lower pair to the top of the handle means. Preferably, the span of the yoke means along the length of the racket is greater than the distance between the yoke means and the handle portion.

According to a specific form of the invention the yoke means comprises a lower strut portion whose ends engage the inside opposed surfaces of the frame at a first or lower pair of the opposed points and an upper arcuate portion that is convex toward the handle portion for supporting main strings. The lower strut portion is closer to the handle portion than the arcuate upper portion. A pair of strut portions diverge from the center of the lower strut portion to a connecting point near the ends of the upper arcuate portion at a junction with respective opposed legs whose outside ends engage the inside opposed surfaces of the frame at a second upper pair of the opposed points. The surfaces of the yoke means in contact with points on the inside surface of the frame in the throat portion are shaped to be generally parallel to these surfaces and terminate on friction pads made of rubber or other suitable material that allows relative displacement between the yoke means and the frame when desired during adjustment but prevents movement when undesired during play.

According to a specific form of the invention, the means for controlling the relative displacement comprises at least one tension rod or wire secured at the upper end to the lower strut portion and at the lower end to a member in the handle portion and is threaded at at least one end so that rotation of an adjusting screw secured to the tension rod or wire displaces the yoke means along the length of the racket to effect control of the tension in the strings. In one form of the invention the adjusting screw (or nut) is at the bottom of the handle portion at the racket end. In another form of the invention, the adjusting screw is in the yoke means to facilitate better balance.

Numerous other features, objects and advantages of the invention will become apparent from the following specification when read in connection with the accompanying drawing in which:

DETAILED DESCRIPTION OF PREFERRED EMBODIMENTS

Figure 1:
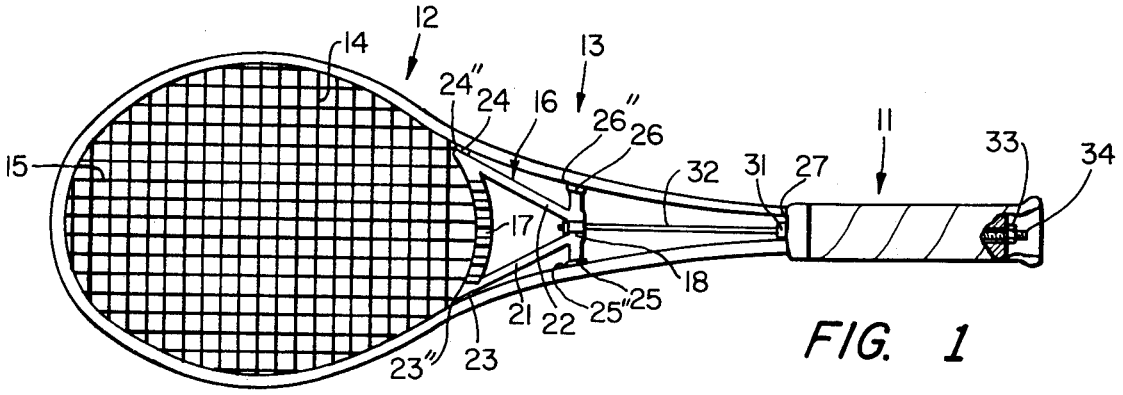
FIG. 1 is a plan view of an exemplary embodiment of the invention.

With reference now to the drawing and more particularly FIG. 1 thereof, there is shown a plan view of an embodiment of the invention having a frame portion generally constructed in accordance with the teachings of U.S. Pat. No. 3,625,512. The frame is typically a double hollow aluminum extrusion bent into racket shape as shown having a handle portion 11, a head portion 12 and a throat portion 13 intermediate the handle portion and head portion. The head portion 12 comprises means for supporting the cross strings such as 14 and the main strings such as 15. The throat portion 13 accommodates yoke 16 that is relatively movable for controlling string tension while also helping to provide support for the racket to help keep it rigid during play. It is convenient to consider the head at the top of the racket, the handle at the bottom of the throat above the handle and below the head.

Yoke 16 includes an upper arcuate portion 17 that is convex toward the handle portion for supporting main strings, such as 15 at their lower ends. Yoke 16 also includes a lower strut portion 18 and a pair of strut portions 21 and 22 that diverge from the center of lower strut portion 18 to respective points near the ends of upper arcuate portion 17 at the junction with legs 23 and 24, respectively, that contact the inside surface of the frame at an opposed pair of points. The surfaces of legs 23 and 24 in contact with the inside of the frame are formed to be generally parallel to the frame surfaces they contact. While contact is actually along surfaces, the area of these surfaces is so small that it is convenient to refer to them as points. Similarly the ends 25 and 26 of lower strut portion 18 are shaped to be generally parallel to the inside surfaces of the frames they contact. The legs and ends 23–26 actually make contact through friction pads 23'', 24'', 25'', and 26'', respectively, made of rubber seated on nylon feet or other suitable material that allows adjustment of yoke position to set tension but prevents changes in position that are not desired during play. The portion of each of legs 23 and 24 and ends 25 and 26 along the length of racket 11 is a number of times less than the span of yoke 16 along the racket length. The advantage of this structural feature is explained below.

The opposed frame portions are fastened together at the top 27 of handle portion 11 by a member that carries a collar 31 through which tension rod 32 passes. The lower portion of handle 11 is shown cut away to illustrate in section how the lower end of tension rod 32 is seated inside a hex or Allen screw 33 seated in internally threaded member 34 at the bottom of handle portion 11 so that rotating hex screw 33 with a hex wrench extends and retracts tension member 32 secured at the top above lower strut portion 18 between diverging strut portions 21 and 22 so as to raise and lower yoke 16 and thereby loosen and tighten, respectively, the strings.

The opposed portions of the frame in the throat portion 13 are maintained in fixed relationship at the top 27 of handle portion 11 and may bend about fulcrums essentially passing through the top 27 of handle portion 11. By making the span of yoke 16 along the racket length less than the length of the space between the fulcrums at the top of the handle portion and the lower strut portion 18 which is also greater than the span of lower strut portion 18 along the racket width direction, it is practical to displace yoke 16 significantly along the length of the racket over a continuum of positions between a first position corresponding to minimum tension and a second position corresponding to maximum tension with yoke 16 then closer to handle portion 11 than when in the first position, this range typically being ⅝ inch, without placing impractical stresses in the racket frame.

Having described the structure of an embodiment according to the invention, the principles behind the invention will be discussed. With tension member 32 pulling yoke 16 toward handle portion 11, the sections of the frame in throat portion 13 from the handle top 27 to the legs 23 and 24 are under compressive stress. The load in the plane of the racket is eccentric to the frame portion near yoke 16 and would bring the frame near buckling failure at the region of the bottom of yoke 16 nearest the handle portion if a yoke of the type shown in the aforesaid patents.

With a prior art yoke failure may occur or the portions under compressive and eccentric loads in the throat portion may exhibit an apparent decrease in resistance to bending when the racket strikes a ball to produce a floppy feeling in the racket which tends to worsen as the strings are tightened, an effect involving apparent reduction of the effective stiffness that can occur at stress levels below yield and at reasonable levels for use.

The lower strut portion 18 of the yoke according to the invention prevents further buckling at the lower portion of the yoke to effectively form two pairs of shorter columns extending from and tracking movement of lower strut portion 18. The invention effectively takes advantage of column failure to achieve advantageous results in forming the two shorter columns and allowing tracking.

The invention overcomes the elastic instability producing the floppy feeling because the structure effectively divides the columns between handle and head portions in the throat portion into two columns in series each of a length shorter than the effective length of the single column effected by a prior art yoke to produce greater stability because the elastic instability is proportional to the square of the effective column free length. Thus the invention results in an effective column length long enough to allow bending without developing undue stresses as the yoke is moved towards the handle portion while being short enough to prevent the elastic instability.

The invention also solves another problem. Because the frame portions are typically bent into curved shapes in the throat, any matching curve of a yoke at a given height will only match at that height, thereby producing a gap as a prior art yoke is displaced. With the yoke according to the invention, the contact points are small so that the magnitude of any mismatch is small and within practically controllable limits. Furthermore, by allowing a small amount of buckling as described above in the frame portions between the plane including legs 23 and 24 and the plane including handle top 27, the gap that might otherwise appear near ends 25 and 26 as tension is tightened by moving yoke 16 closer to handle portion 11 closes as the frame portion buckles to produce a reasonable amount of force holding the frame portions in good contact with ends 25 and 26 so that the whole assembly is quite solid, the upper portion of yoke 16 being secured firmly between the frame portions by the tension produced by the cross strings. Furthermore, ends 25 and 26 press against effective preloaded arches functioning as trussed beams in the frame portion between the aforesaid planes to enhance system stiffness. Another advantage of the invention resides in the yoke being stable in the presence of unequal forces on the main strings as occurs when the racket strikes a ball off center.

Figure 3:
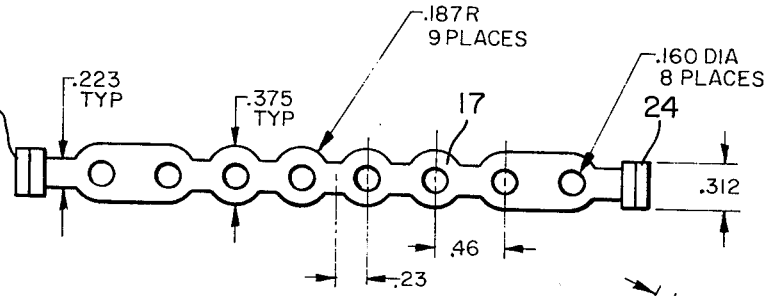
FIGS. 2–4 are plan, top and bottom views of the specific yoke means shown in FIG. 1.
Figure 2:
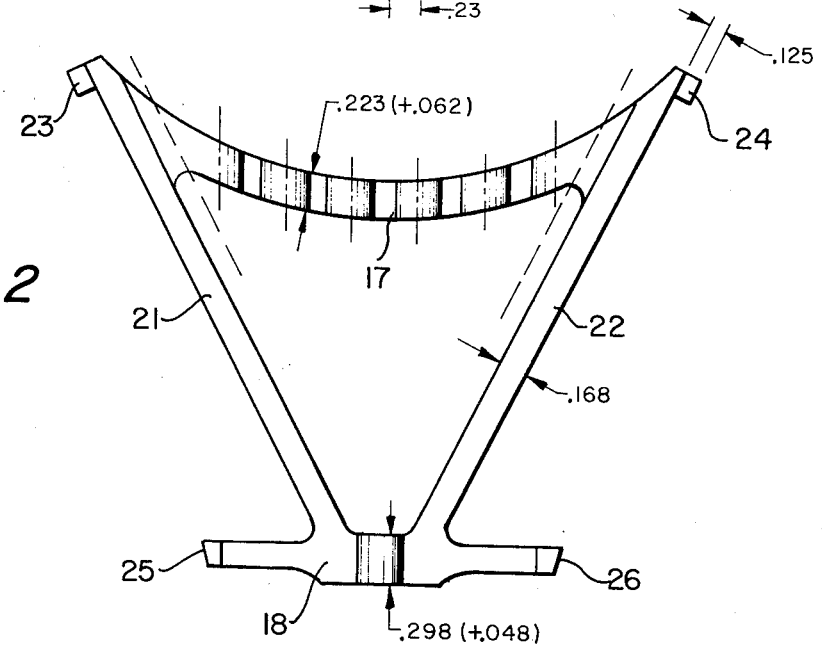
Figure 4:
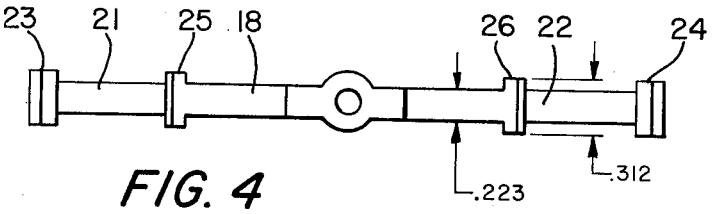

Referring to FIGS. 2–4, there are shown plane, top and bottom views of yoke 16 with specific dimensions used in an exemplary embodiment of the invention. The same reference symbols identify corresponding elements throughout the drawing. Material may be aluminum and an acceptable section dimension for diverging struts 21 and 22 is 0.168 × 0.223 inch.

Figure 6:
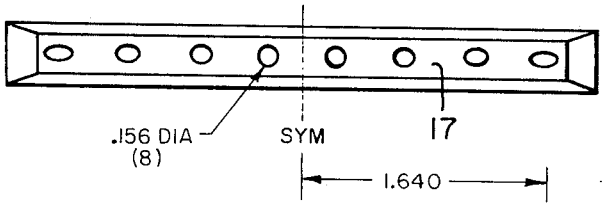
FIGS. 5–7 are plan top and bottom views of another embodiment of suitable yoke means.
Figure 5:
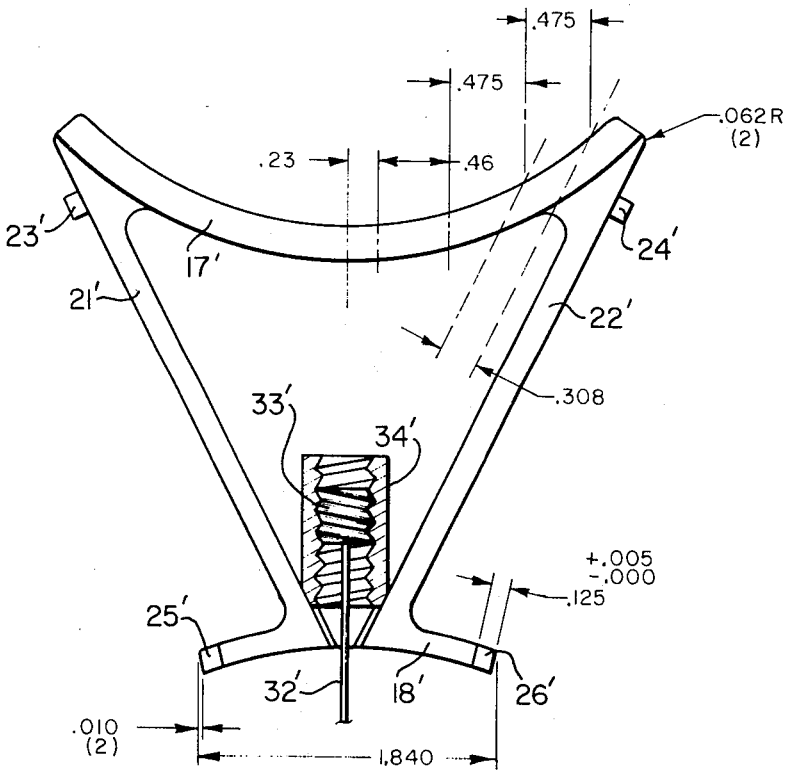
Figure 7:
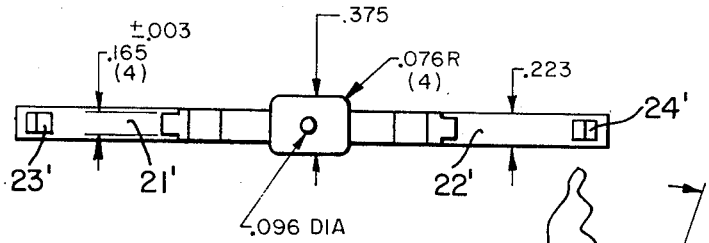

Referring to FIGS. 5–7, there is shown plan, top and bottom views, respectively, of an alternate embodiment of the invention which also shows a means for adjusting the position of yoke 16 with a hex or Allen screw 33' seated in a threaded barrel 34' at the top of tension wire 32' instead of the bottom with threaded barrel 34' being seated between diverging strut portions 21' and 22' extending from the central portion of lower strut portion 18' that is slightly arcuate and has a concave portion facing the handle portion. This means of adjustment could be located in other yokes. Strut portions 21' and 22' diverge toward a connecting point with the ends of upper arcuate strut portion 17' and carry legs 23' and 24' slightly below this junction. Ends 25' and 26' function similarly to ends 25 and 26 of the yoke in FIGS. 1–4.

Figure 8:
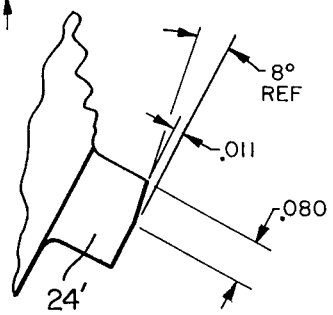
FIG. 8 is a detailed drawing of an upper leg with FIG. 5 showing an alternate arrangement whereby the adjusting screw is in the yoke means instead of the handle portion.

Referring to FIG. 8 there is shown a detail of legs 23 and 23' and 24 and 24' showing the slightly tapered upper half portion of each leg that facilitates establishing good surface contact with the inside portion of the frame over a relatively wide range of lengthwise movement.

There has been described novel apparatus and techniques for making a practical high performance game racket with string tension adjustable over a wide range of tensions while retaining high playability. The radii of curvature of arcuate portions 17 and 17' are 2.656 inches and 2.550 inches respectively for accommodating eith main strings. A range for this radius of curvature between two and three inches is believed to include acceptable values.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Game racket apparatus with means for adjusting string tension comprising, means defining a racket frame having a head portion for carrying main and cross strings, a throat portion for accommodating yoke means and a handle portion for gripping by a player, said yoke means located in said throat portion between opposed portions of said frame for both bracing said game racket and supporting main strings, said yoke means contacting the inside surface of said frame in said throat portion at opposed pairs of contact points spaced along the length of said game racket by a distance a number of times greater than the span of each of said contact points along the length of said game racket, said yoke means being adjustable along the length of said spparatus with said throat portion being free from obstructions preventing selective movement toward and away from said handle portion to tighten and loosen respectively main and cross strings of said racket, and displacing means for selectively displacing said yoke means along the length of said game racket from said normal position to others both toward and away from said handle portion for tightening and loosening respectively main and cross strings simultaneously, the opposed portions of said frame being relatively movable in response to yoke means adjustment for increasing and decreasing the tension in main and cross strings simultaneously.

2. Game racket apparatus in accordance with claim 1 and further comprising, means located in said handle portion for keeping opposed portions of said frame a fixed distance apart at a fulcrum location along the length of said game racket apparatus spaced from said yoke means by a lengthwise distance that is greater than the span of said yoke means along the length of said game racket which fulcrum location embraces the fulcrums about which the opposed frame portions may pivot as said yoke means moves toward and from said handle portion with said game racket being free of means for keeping opposed portions of said frame a fixed distance apart between the fulcrum location and the yoke means.

3. Game racket apparatus with adjustable string tension in accordance with claim 2 wherein the distance between said fulcrum location and said yoke means is greater than the span across said yoke means nearest said handle portion in a direction along the width direction of the game racket.

4. Game racket apparatus in accordance with claim 1 wherein said yoke means includes strut means for effectively dividing the frame portions between said handle portion and said head portion into columns in series and preventing buckling failure.

5. Game racket apparatus in accordance with claim 4 wherein said strut means is between arch portions of said frame in compression to coact therewith to comprise effectively trussed beams.

6. Game racket apparatus in accordance with claim 1 wherein said yoke means comprises an upper arcuate portion that is convex toward said handle portion for supporting main strings extending between an upper pair of said opposed points and a lower strut portion extending between a lower pair of said opposed points for effectively dividing the frame portions between said handle portion and said head portion into columns in series and preventing buckling failure.

7. Game racket apparatus in accordance with claim 6 and further comprising diverging strut portions extending from the middle of said lower strut portion to the opposed ends of said upper arcuate portion.

8. Game racket apparatus in accordance with claim 7 and further comprising a tension member secured to said yoke means above said lower strut portion between said diverging portions and to said handle portion, and means for varying the length of said tension member between the point where connected to said yoke means and the point where connected to said handle portion to correspondingly displace said yoke means along the length of said apparatus and thereby control the adjustment of string tension.

9. Game racket apparatus in accordance with claim 8 wherein said means for varying comprises relatively movable elements in said yoke means.

10. Game racket apparatus in accordance with claim 1 and further comprising pads at said opposed pairs of points for establishing frictional engagement that prevents said yoke means from undesired changes during play while allowing lengthwise movement when selectively adjusting yoke position for adjusting string tension.

* * * * *